United States Patent [19]

Ruger et al.

[11] Patent Number: 4,823,698

[45] Date of Patent: Apr. 25, 1989

[54] SHEET GRIPPER ASSEMBLY FOR A SHEET-FED ROTARY PRINTING PRESS

[75] Inventors: Manfred Ruger, Heusenstamm; Valentin Gensheimer, Muhlheim/Main, both of Fed. Rep. of Germany

[73] Assignee: M.A.N. Roland Druckmaschinen, Fed. Rep. of Germany

[21] Appl. No.: 213,437

[22] Filed: Jun. 27, 1988

Related U.S. Application Data

[63] Continuation of Ser. No. 892,781, Jul. 31, 1987, abandoned.

[30] Foreign Application Priority Data

Aug. 19, 1985 [DE] Fed. Rep. of Germany ..... 3529599

[51] Int. Cl.[4] ..... B41F 1/30

[52] U.S. Cl. ..... 101/409; 101/379; 101/415.1

[58] Field of Search ..... 101/379, 382, 383, 384, 101/408, 409, 415.1

[56] References Cited

U.S. PATENT DOCUMENTS

| | | | |
|---|---|---|---|
| 4,203,303 | 5/1980 | Walter et al. | 101/409 |
| 4,263,849 | 4/1981 | Spac et al. | 101/415.1 |
| 4,372,209 | 2/1983 | Jentzsch et al. | 101/409 |
| 4,377,974 | 3/1983 | Kirkpatrick | 101/415.1 X |
| 4,437,942 | 3/1984 | Datwyler | 101/915.1 X |
| 4,442,772 | 4/1984 | Bubley | 101/415.1 X |
| 4,596,188 | 6/1986 | Bonomi | 101/415.1 |
| 4,598,641 | 7/1986 | Fiseher | 101/409 X |
| 4,603,641 | 8/1986 | Seschke et al. | 101/415.1 |

FOREIGN PATENT DOCUMENTS

| | | | |
|---|---|---|---|
| 493269 | 3/1930 | Fed. Rep. of Germany | 101/409 |

*Primary Examiner*—Edgar S. Burr
*Assistant Examiner*—James R. McDaniel

[57] ABSTRACT

A sheet gripper assembly for a sheet-fed rotary printing press having a gripper tip with a non-resilient pressure element fastened to the gripper tip by a layer of resilient material, the pressure element having a central protuberance, extending through the resilient layer, upon which the gripper tip bears.

4 Claims, 1 Drawing Sheet

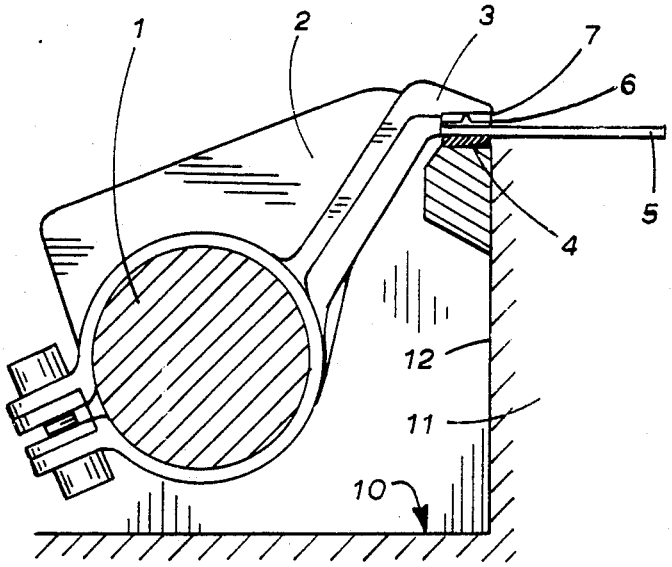
FIG. 1
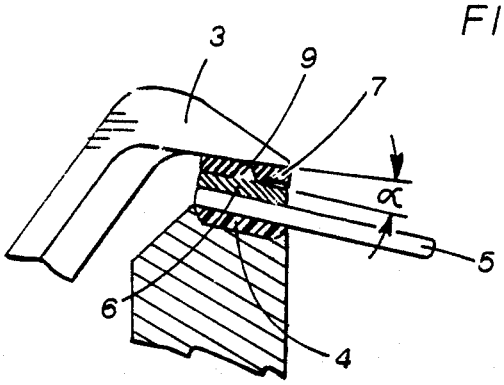
FIG. 2
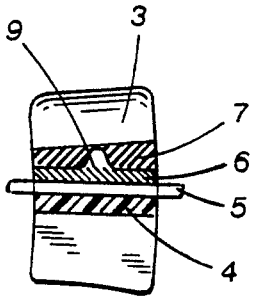
FIG. 3
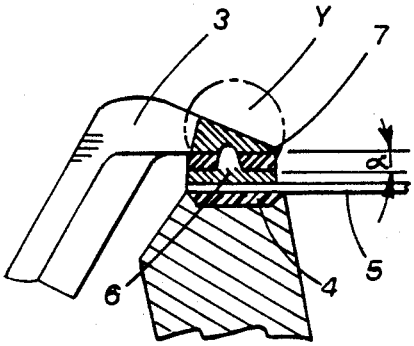
FIG. 4
FIG. 5
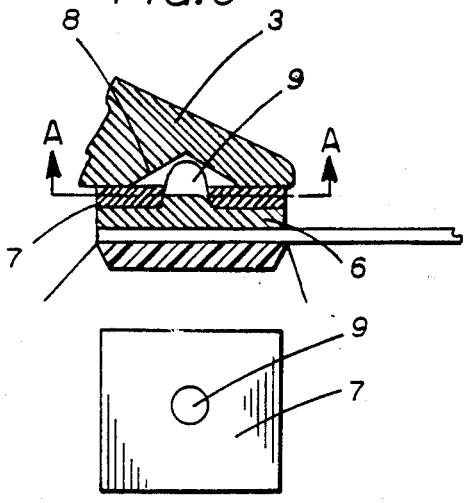
FIG. 6

SHEET GRIPPER ASSEMBLY FOR A SHEET-FED ROTARY PRINTING PRESS

This application is a continuation, of application Ser. No. 892,781, filed July 31, 1987, now abandoned.

FIELD OF THE INVENTION

The present invention relates generally to a sheet gripper assembly for a sheet-fed rotary printing press and more particularly concerns such a gripper with a non-resilient retaining surface.

BACKGROUND OF THE INVENTION

The primary disadvantage of sheet grippers for sheet-fed rotary printing presses is that the retaining surfaces cannot compensate for errors in parallelism caused by variations in operational, manufacturing and assembly parameters nor for the effect of the thickness of the material being printed. Since a sheet is retained non-positively, an error in parallelism will result in non-uniform gripping pressure over the area of the retaining surface. The non-uniform gripping pressure leads to an increased likelihood of slipping, especially when smooth paper is being printed at high press speeds, which, in turn, causes registration errors rendering the printed material unusable.

OBJECTS AND SUMMARY OF THE INVENTION

The primary object of the present invention is to provide a sheet gripper assembly such that, with the gripper closed, the retaining surface of the gripper tip is always aligned parallel to the sheet material being printed and to the gripper support.

This is accomplished, according to the present invention, by a non-resilient pressure element fastened to the gripper tip by a layer of resilient material, the pressure element having a central protuberance, extending through the resilient layer, upon which the gripper tip bears.

The primary advantage of the present invention is that even in the presence of errors in parallelism due to operating, manufacturing and assembly variations, the gripper tip always bears on the gripper support in a plane-parallel relationship without any need for manual adjustment.

These and other features and advantages of the invention will be more readily apparent upon reading the following description of a preferred exemplified embodiment of the invention and upon reference to the accompanying drawings wherein:

BRIEF DESCRIPTION OF THE DRAWINGS

FIG. 1 is a diagrammatic view of a sheet gripper assembly disposed in the recess of a rotary printing press cylinder;

FIG. 2 is an enlarged, fragmentary section through the sheet gripper retaining surfaces;

FIG. 3 is an enlarged, fragmentary side view of the retaining surfaces;

FIG. 4 is a fragmentary section through the retaining surfaces similar to FIG. 2, showing a swivel mounting for the upper retaining surface;

FIG. 5 shows an enlarged detail in the area Y of FIG. 4; and

FIG. 6 is a section taken substantially along the line A—A in FIG. 5.

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Turning now to the drawings, FIG. 1 shows a sheet gripper assembly for engaging and conveying sheets 5. A sheet gripper finger 2 having a gripper tip 3 is secured to a gripper shaft 1 disposed in a recess 10 of a cylinder 11 of a sheet-fed rotary printing press, the other details of which are not shown. The sheet 5 is retained between a gripper support having a first sheet retaining surface 4 mounted on a wall 12 in the recess 10 of the cylinder 11 and a retaining surface on the underside of a non-resilient pressure element 6 secured to the gripper tip 3. As FIG. 2 shows, the non-resilient pressure element 6 is preferably secured to the gripper tip 3 by the interposition of a resilient intermediate layer 7, and a bearing protuberance 9 is provided at the center of the pressure element 6.

In accordance with the invention, the angle $\alpha$ between the upper and lower surfaces of the resilient intermediate layer 7 varies to ensure that the retaining surfaces, when in the gripping position, are always parallel to one another regardless of the thickness of the paper sheet 5. Also, as can be seen in FIG. 3, the resilient intermediate layer 7 cooperating with the central protuberance 9 helps to compensate for any minor skewing of the tip 3 and support 4. In the preferred embodiment, as FIGS. 4 and 5 show, the protuberance 9 can also be mounted rockably in a notch guide 8 in the tip 3 to provide additional centering for the pressure element 6.

From the foregoing, it will be appreciated that errors arising from variations in operational, manufacturing and assembly parameters as well as from differences in the thickness of the paper being printed can be obviated. Preferably, the surface of the pressure element 6 has a covering of a very hard granular material, such as silicon and tungsten carbide and corundum and molybdenum, whereas the retaining surface of the support 4 is preferably made of a smooth resilient substance whose hardness is more than 90° Shore.

We claim as our invention:

1. A sheet gripper assembly for a sheet-fed rotary printing press comprising a sheet gripper support defining a first sheet retaining surface, a gripper having a tip at one end thereof, said gripper being mounted for rotational movement relative to said support for moving said gripper tip between a retracted position and sheet gripping position in closely adjacent relation to said first sheet retaining surface, a non-resilient pressure element mounted on said tip, said non-resilient pressure element defining a second retaining surface that cooperates with said first retaining surface for engaging a sheet therebetween upon rotational movement of said gripper tip to said sheet gripping position, a resilient intermediate layer element interposed between said gripper tip and said non-resilient pressure element, and said non-resilient pressure element being formed with a protrusion disposed in adjacent relation to said gripper tip for creating a pivot point that permits limited relative movement of said non-resilient pressure element with respect to said gripper tip and the interposed resilient layer element so as to ensure parallel positioning of the retaining surface of said non-resilient pressure element with respect to the retaining surface of the gripper support upon engagement of a sheet therebetween.

2. A sheet gripper assembly according to claim 1, wherein said gripper tip is formed with a notch guide for receiving said protuberance so as to center said pressure element.

3. A sheet gripper assembly according to claim 1, wherein said second retaining surface is defined by a covering of a hard granular material on said nonresilient pressure element.

4. A sheet gripper assembly according to claim 1, wherein said first retaining surface is formed of a resilient substance having a hardness of at least 90° Shore.

* * * * *